United States Patent [19]

Waddoups et al.

[11] Patent Number: 5,021,173

[45] Date of Patent: Jun. 4, 1991

[54] FRICTION MODIFIED OLEAGINOUS CONCENTRATES OF IMPROVED STABILITY

[75] Inventors: Malcolm Waddoups, Westfield, N.J.; Jacob Emert, Brooklyn, N.Y.

[73] Assignee: Exxon Chemical Patents, Inc., Linden, N.J.

[21] Appl. No.: 575,048

[22] Filed: Aug. 30, 1990

Related U.S. Application Data

[63] Continuation of Ser. No. 160,686, Feb. 26, 1988, abandoned.

[51] Int. Cl.[5] ..... C10M 141/06; C10M 141/12

[52] U.S. Cl. ..... 252/35; 252/51.5 A; 252/56 R; 252/75

[58] Field of Search ..... 252/35, 51.5 A, 56 R, 252/75

[56] References Cited

U.S. PATENT DOCUMENTS

| | | | |
|---|---|---|---|
| 2,343,756 | 3/1944 | Downing et al. | 252/37 |
| 2,356,661 | 8/1944 | Downing et al. | 252/37 |
| 2,356,662 | 8/1944 | Endsley | 153/64 |
| 2,552,580 | 5/1951 | Persson | 81/41 |
| 3,180,832 | 4/1965 | Furey | 252/56 |
| 3,271,310 | 9/1966 | Le Suer | 252/35 |
| 3,273,981 | 9/1966 | Furey | 44/66 |
| 3,328,298 | 6/1967 | Asseff | 252/32.7 |
| 3,346,493 | 10/1967 | Le Suer | 252/32.5 |
| 3,351,647 | 11/1963 | Butler et al. | 260/429.9 |
| 3,401,185 | 9/1968 | Meinhardt | 260/429.9 |
| 3,429,817 | 2/1969 | Furey et al. | 252/56 |
| 3,509,052 | 4/1970 | Murphy | 252/34.7 |
| 3,652,616 | 3/1972 | Watson et al. | 260/429 R |
| 4,105,571 | 8/1978 | Shaub et al. | 252/32.7 E |
| 4,122,033 | 10/1978 | Black | 252/400 A |
| 4,388,201 | 6/1983 | Brownawell et al. | 252/49.6 |
| 4,417,990 | 11/1983 | Clason et al. | 252/32.7 E |
| 4,459,223 | 7/1984 | Shaub et al. | 252/51.5 R |
| 4,479,883 | 10/1984 | Shaub et al. | 252/32.7 E |
| 4,505,829 | 3/1985 | Wisotsky | 252/32.7 E |
| 4,552,677 | 11/1985 | Hopkins | 252/33.6 |
| 4,557,846 | 12/1985 | Wisotsky | 252/51.5 |
| 4,617,026 | 10/1986 | Shaub et al. | 44/70 |
| 4,617,134 | 10/1986 | Shaub | 252/32.7 E |
| 4,648,985 | 3/1987 | Thorsell et al. | 252/32.5 |
| 4,664,822 | 5/1987 | Hunt et al. | 252/32.7 E |
| 4,683,069 | 7/1987 | Brewster et al. | 252/32.7 E |
| 4,684,473 | 8/1987 | Bock et al. | 252/49.8 |

FOREIGN PATENT DOCUMENTS

| | | |
|---|---|---|
| 1189307 | 6/1985 | Canada . |
| 0092946 | 2/1983 | European Pat. Off. . |
| 0024146 | 9/1985 | European Pat. Off. . |
| 0225580 | 6/1987 | European Pat. Off. . |
| 0271363 | 6/1988 | European Pat. Off. . |
| 85-01513 | 4/1985 | PCT Int'l Appl. . |
| 0827536 | 5/1981 | U.S.S.R. . |

OTHER PUBLICATIONS

*Machine Design*, (vol. 46—No. 1, May 2, 1974, pp. 108–110, Green et al.).

*Primary Examiner*—Prince E. Willis
*Assistant Examiner*—Jerry D. Johnson
*Attorney, Agent, or Firm*—J. B. Murray, Jr.

[57] ABSTRACT

According to the present invention, oleaginous compositions having improved storage stability properties are provided, which comprise a combination of ashless dispersants, friction modifier and oil-soluble copper antioxidants, wherein the composition is substantially free of boron.

54 Claims, No Drawings

FRICTION MODIFIED OLEAGINOUS CONCENTRATES OF IMPROVED STABILITY

CROSS REFERENCE TO RELATED APPLICATIONS

This application is a Rule 60 continuation of Ser. No. 160,686, filed Feb. 26, 1988 now abandoned.

BACKGROUND OF THE INVENTION

1. Field of the Invention

This invention relates to oil soluble additive mixtures useful in fuel and lubricating oil compositions, including concentrates containing said additives, and methods for their manufacture and use. The additive mixture comprises an ashless non-borated dispersant, copper antioxidant, and friction modifiers having improved storage stability.

2. Description of the Prior Art

Heretofore, many lubricants and fuels have contained compounds known as friction modifiers (also termed "lubricity additives"), which act to reduce the friction of internal engine parts and thereby increase fuel economy. U.S. Pat. No. 3,429,817 relates to the improvement of the lubricity and load carrying ability of a synthetic ester lubricating oil by addition of an ester formed by reacting about 2 moles of $C_2$ to $C_5$ glycol with about 1 mole of $C_{36}$ dicarboxylic acid dimer of a $C_{18}$ unsaturated fatty acid (e.g., linoleic acid or oleic acid). U.S. Pat. No. 3,273,981 is directed to fuels and lubricating oil containing as lubricating additive a mixture of dimer acids and polyhydric alcohol partial esters. U.S. Pat. No. 4,459,223 relates to lubricating oil friction reducing additives which are the reaction product of a dimer carboxylic acid (e.g., linoleic acid dimers) and a polyhydric alcohol having at least 3 hydroxyl groups. U.S. Pat. No. 4,479,883 relates to lubricating oil compositions having a relatively low level of phosphorous and improved friction reducing properties by use of a mixture of a glycol or glycerol ester of a polycarboxylic acid (e.g., linoleic acid dimers) with Mo, Zn, or Sb dithiocarbamates. U.S. Pat. No. 4,557,846 relates to lubricating oil friction reducing additives comprising oil soluble hydroxyamide compounds prepared by condensing a dimer carboxylic acid (e.g., linoleic acid dimers) with a hydroxyamine. U.S. Pat. No. 4,617,026 relates to fuel friction modifying additives comprising hydroxyl-containing esters of a $C_{12}$ to $C_{30}$ monocarboxylic acid and a glycol or trihydric alcohol, wherein the glycol can comprise polyalkylene glycols having 2 to 100 oxyalkylene repeat units. U.S. Pat. No. 4,683,069 relates to lubricating oil fuel economy additives comprising glycerol partial esters of $C_{16}$–$C_{18}$ fatty acids.

The instability, and hence the need for a stabilization of, compositions containing polycarboxylic acid-glycol esters, ashless dispersant and certain metal lubricating oil additives has been noted in the art. U.S. Pat. No. 4,105,571 is directed to storage stable lubricating compositions having improved anti-friction and anti-wear properties containing a zinc dihydrocarbyldithiophosphate, an ester of a polycarboxylic acid and a glycol, and an ashless high molecular weight dispersant, wherein either the zinc or ester component, or both, are predispersed with the ashless dispersant prior to adding them to the lubricating composition. The friction modifying esters are disclosed to include linoleic acid dimers which are esterified with glycol such as diethylene glycol.

U.S. Pat. No. 4,388,201 discloses lubricating oil compositions containing such polycarboxylic acid-glycol friction modifier esters in combination with borated or non-borated alkenyl succinimide dispersants, by the addition of small proportions of a co-dispersant comprising an oil-soluble hydrocarbyl substituted mono- or bis-oxazoline or lactone oxazoline.

U.S. Pat. No. 4,505,829 discloses lubricating oil compositions containing polycarboxylic acid, glycol esters as friction modifiers in combination with hydrocarbon soluble alkenyl succinimide dispersants with reduced tendency towards formation of sediment upon storage. The storage stability is improved by the addition thereto of small proportions of polyol or polyol anhydride partial esters of a fatty acid or an ethoxylated fatty acid, amine or amide compound.

U.S. Pat. No. 4,617,134 relates to storage stable lubricating oil compositions comprising an additive combination of a polycarboxylic acid glycol or glycerol ester, as friction modifier, and zinc dihydrocarbyldithiophosphate and an ashless dispersant containing a selected amount of free hydroxyl groups.

U.S. Pat. No. 4,684,473 relates to solubilization of oxygenated (hydroxy) esters of a dimer acid (including linoleic dimer esters of polyhydric alcohols) by the incorporation in the lubricating composition of an $C_4$–$C_{23}$ oil soluble alkanol or an oil soluble alkyl phosphate. It is disclosed that the selection of the chain length of the alcohol is critical.

European Patent 24,146 relates to lubricating compositions containing oil-soluble copper compounds in an amount sufficient to retard or inhibit oxidation of the lubricant during use (5 to 500 ppm Cu) , and discloses that such lubricant compositions can further comprise from 1 to 10 wt. % ashless dispersant compounds. Preferred are dispersants derived from polyisobutenyl succinic anhydride and polyethylene-amines, which dispersants can be further modified with a boron compound to provide about 0.1 to 10 atomic proportions of boron per mole of the acylated nitrogen compound. In addition, the patent discloses that the lubricant compositions can also contain rust inhibitors such as lecithin, sorbitan monooleate, dodecyl succinic anhydride or ethoxylated alkyl phenols; and other additives such as pour point depressants, viscosity index improvers, other antioxidants (e.g., zinc dialkyldithiophosphates), basic alkaline earth metal detergents, etc. Illustrative of oil-soluble copper compounds are copper dihydrocarbyl thio- or dithio-phosphates, copper salts of a synthetic or natural carboxylic acid (e.g., $C_{10}$ to $C_{18}$ fatty acids, oleic acid, naphthenic acids) and the like.

U.S. Pat. No. 4,552,677 relates to compositions comprising copper salts of substituted succinic anhydride derivatives containing a hydrocarbon-based substituent group containing from about 8 up to about 35 carbon atoms, which the patentee indicates are effective antioxidants for crackcase lubricants.

U.S. Pat. No. 3,509,052 relates to lubricating oil compositions containing a lubricating oil, a dispersant (which is a derivative of a substituted succinic acid where the substituent contains at least 50 aliphatic carbon atoms), and a demulsifier, e.g., polyoxyalkylene polyols, together with other additives, such as rust inhibitors, oxidation and corrosion inhibitors. The dispersant is said to also permissibly comprise boron post-treated alkyl-substituted succinimides, or metal salts of substituted succinic acids (wherein the metal is preferably a Group I or II metal, Al, Pb, Sn, Co, Ni or Zn).

European Patent No. 92,946 relates to the combination of oil-soluble copper compounds with glycerol fatty acid esters as fuel economy additives.

U.S. Pat. No. 2,356,661 deals with lubricating oils containing 50 to 100 parts per million of copper together with an oil-soluble organic sulphur compound to provide more stable lubricants which can be employed in internal combustion engines over longer periods of time without causing objectional increase in the viscosity of the oils and with the formation of less deposits in the engine and with less corrosion of sensitive bearing metals. U.S. Pat. Nos. 2,343,756 and 2,356,662 disclose the addition of copper compounds, in conjunction with sulfur compounds, to lubricating oils. In U.S. Pat. No. 2,552,570, cuprous thiophosphates are included in lubricant compositions at relatively high levels, which results in undesirably high sulfated ash content. In U.S. Pat. No. 3,346,493, a wide variety of polymeric amine-metal reactants are employed as detergents in lubricant compositions. In the two isolated instances in which the metal is copper and the composition contains zinc dihydrocarbyldithiophosphate, either the amount of copper employed is outside the range of the present invention or it is necessary that the oil insoluble copper compound be complexed with the dispersant. U.S. Pat. No. 3,652,616 discloses a wide variety of polymeric amine-metal reactants for addition to lubricating compositions. U.S. Pat. No. 4,122,033 discloses the entire group of transition metal compounds as additives for lubricants.

U.S. Pat. No. 3,271,310 relates to metal salts of alkenyl succinic acid, which are disclosed to be useful as detergents and rust inhibitors in hydrocarbon oils and which comprise metal salts of a hydrocarbon substituted succinic acid having at least about 50 aliphatic carbon atoms in the hydrocarbon substituent wherein the metal comprises Group I, Group II, aluminum, lead, tin, cobalt or nickel. The salts are disclosed to be useful in lubricating oils in amounts of from 0.1 to about 20 wt. % and in lubricating compositions for using gasoline internal combustion engines in an amount of from 0.5 to about 5 wt. %. The salts are disclosed to be useful in combination with ashless dispersants, including those which have been borated by reaction with boric acid. Further, the salts are indicated to be useful as emulsifying agents in water in oil emulsions, and that when so employed, other emulsion additives such as rust inhibitors can be used.

U.S. Pat. No. 3,351,647 relates to the phosphorus and nitrogen containing reaction products formed by reacting a metal salt of a phosphinodithioic acid with an amine such as an aliphatic amine having from 1 to about 40 carbon atoms. Copper is among a group of metals disclosed to be useful. The compositions are disclosed as additives for lubricating oils and automatic transmission fluids, in which they act as oxidation inhibitors and anti-wear agents. These compositions are stated to be useful in combination with ashless detergents such as the reaction product of triethylenetetraamine with an alkenyl substituted succinic anhydride having at least 50 carbon atoms in the alkenyl substituent.

U.S. Pat. No. 3,401,185 relates to metal salts of phosphorus acids, including copper salts of such acids, useful in lubricating oils in combination with ashless dispersants which may be borated.

U.S. Pat. No. 3,328,298 relates to metal (e.g., copper) containing compositions formed by reacting a basic inorganic metal compound with an intermediate formed by reacting a phosphorothioic acid diester with an equimolar amount of an epoxide. The resulting metal containing compositions are disclosed to be useful in combination with ashless dispersants.

U.S. Pat. No. 4,417,990 relates to mixed metal salts/-sulfurized phenate compositions.

U.S. Pat. No. 4,664,822 relates to certain copper ore based metal containing compositions which are disclosed to be useful in combination with other additives, among which ashless containing dispersants (which can be borated), zinc dialkyldithiophosphates, ash-containing detergents, and ashless rust inhibitors are mentioned.

Canadian Patent No. 1,189,367 relates to hydrocarbon soluble compositions containing a transition metal salt of an organic acid, a hydrocarbon soluble ashless dispersant and a phenolic antioxidant, which composition can additionally comprise dyes, metal deactivators, and, particularly, demulsifying agents. The transition metal salts mentioned include copper organic salts, and the organic acids include carboxylic acids, sulfonic acids and phosphorus acids. It is indicated that the transition metal salts used in the invention are often overbased and contain an excess of one equivalent of metal per equivalent of acid derived moiety.

U.S. Pat. No. 4,552,677 relates to copper salts of hydrocarbyl substituted succinic acids wherein the hydrocarbon group contains from about 8 to about 35 carbon atoms. Such copper salts are said to be effective antioxidants for crankcase lubricants without the deleterious effect on rust and copper/lead bearing corrosion performance that accompanies copper oleate, which is described in European Patent No. 24,146, discussed above. The copper salts of the '677 patent are said to be useful in combination with other additives including ashless dispersants which may be borated.

U.S. Pat. No. 4,664,822 relates to lubricating oils compositions comprising ashless dispersant and from 0.1 to 1.5 wt % of a copper overbased metal-containing composition as dispersant/detergent, antioxidant and rust inhibitor additive. It is disclosed that the ashless dispersants may be borated, and that the lubricating compositions can contain additional conventional additives, among which are mentioned friction modifiers. Disclosed as suitable friction modifiers are fatty acid derivatives comprising esters such as triglycerides or monoesters from polyols esters such as glycol monooleate and pentaerythritol monooleate amides such as oleamide or amides made from polyamines or alkanolamines; and hereterocycles made by condensing compounds such as aminoquanidine with carboxylic acids to form triazoles. Further disclosed as suitable friction modifiers are Mo compounds, and combinations of Na sulfonates (or Mo compounds) and glycerol monoleates and other fatty acid derivatives.

SUMMARY OF THE INVENTION

According to the present invention, friction modified oleaginous compositions having improved storage stability properties are provided, which comprise a combination of (A) ashless dispersants, (B) friction modifiers comprising glycol ester or hydroxyamine derivatives of polycarboxylic acids, and (C) oil-soluble copper antioxidants, wherein the composition is substantially free of boron and wherein the B:Cu weight ratio is less than about 0.6:1.

It has been surprisingly found that significantly improved storage stability properties (that is, reduced tendency to formation of sediment and haze) are achieved in such compositions, and particularly in concentrates intended for use in preparation of such compositions, by the requirement that such compositions be substantially free of boron, thereby permitting the use of oil soluble copper carboxylate antioxidants, such as copper oleate and copper salts of polyalkylene substituted succinic anhydrides.

DETAILED DESCRIPTION OF THE INVENTION

The present invention relates to oleaginous compositions comprising (A) ashless dispersants, (B) friction modifiers comprising glycol ester and/or hydroxyamide derivatives of certain polycarboxylic acids, and (C) oil-soluble copper antioxidant compounds, wherein the composition is substantially free of boron.

The phrase "substantially free of boron" as used in the instant specification and claims is intended to refer to boron concentrations of less than 30 ppm by weight boron. Preferably, the boron concentration of the compositions of this invention are less than 20 ppm by weight, more preferably less than 10 ppm by weight.

Component A—Ashless Dispersants

Ashless, nitrogen or ester containing dispersants useful in this invention comprise boron-free members selected from the group consisting of (i) oil soluble salts, amides, imides, oxazolines and esters, or mixtures thereof, of long chain hydrocarbon substituted mono and dicarboxylic acids or their anhydrides; (ii) long chain aliphatic hydrocarbon having a polyamine attached directly thereto; and (iii) Mannich condensation products formed by condensing about a molar proportion of long chain hydrocarbon substituted phenol with about 1 to 2.5 moles of formaldehyde and about 0.5 to 2 moles of polyalkylene polyamine; wherein said long chain hydrocarbon group in (i), (ii) and (iii) is a polymer of a $C_2$ to $C_{10}$, e.g., $C_2$ to $C_5$ monoolefin, said polymer having a number average molecular weight of about 300 to about 5000.

A(i) The long chain hydrocarbyl substituted dicarboxylic acid producing material, e.g. acid, anhydride, or ester, used in the invention includes a long chain hydrocarbon, generally a polyolefin, substituted typically with an average of at least about 0.8, usefully from about 1.0 to 2.0 (e.g. 1.0 to 1.6), preferably about 1.1 to 1.4 (e.g. 1.1 to 1.3) moles, per mole of polyolefin, of an alpha- or beta-unsaturated $C_4$ to $C_{10}$ dicarboxylic acid, anhydride or ester thereof, such as fumaric acid, itaconic acid, maleic acid, maleic anhydride, chloromaleic acid, dimethyl fumarate, chloromaleic anhydride, acrylic acid, methacrylic acid, crotonic acid, cinnamic acid, and mixtures thereof.

Preferred olefin polymers for reaction with the unsaturated dicarboxylic acid anhydride or ester are polymers comprising a major molar amount of $C_2$ to $C_{10}$, e.g. $C_2$ to $C_5$, monoolefin. Such olefins include ethylene, propylene, butylene, isobutylene, pentene, octene-1, styrene, etc. The polymers can be homopolymers such as polyisobutylene, as well as copolymers of two or more of such olefins such as copolymers of: ethylene and propylene; butylene and isobutylene; propylene and isobutylene; etc. Other copolymers include those in which a minor molar amount of the copolymer monomers, e.g., 1 to 10 mole %, is a $C_4$ to $C_{18}$ non-conjugated diolefin, e.g., a copolymer of isobutylene and butadiene; or a copolymer of ethylene, propylene and 1,4-hexadiene; etc.

In some cases, the olefin polymer may be completely saturated, for example an ethylene-propylene copolymer made by a Ziegler-Natta synthesis using hydrogen as a moderator to control molecular weight.

The olefin polymers will usually have number average molecular weights within the range of about 700 and about 5000, e.g. 700 to 3000, more usually between about 800 and about 2500, and will therefore usually have an average of from about 50 to 400 carbon atoms. Particularly useful olefin polymers have number average molecular weights within the range of about 900 and about 2500 with approximately one terminal double bond per polymer chain. An especially useful starting material for a highly potent dispersant additive made in accordance with this invention is polyisobutylene.

Processes for reacting the olefin polymer with the $C_{4-10}$ unsaturated dicarboxylic acid, anhydride or ester are known in the art. For example, the olefin polymer and the dicarboxylic acid material may be simply heated together as disclosed in U.S. Pat. Nos. 3,361,673 and 3,401,118 to cause a thermal "ene" reaction to take place. Alternatively, the olefin polymer can be first halogenated, for example, chlorinated or brominated to about 1 to 8 wt. %, preferably 3 to 7 wt. % chlorine, or bromine, based on the weight of polymer, by passing the chlorine or bromine through the polyolefin at a temperature of 60° to 250° C. e.g. 120° to 160° C. for about 0.5 to 10, preferably 1 to 7 hours. The halogenated polymer may then be reacted with sufficient unsaturated acid or anhydride at 100° to 250° C., usually about 180° to 220° C. for about 0.5 to 10 hours, e.g. 3 to 8 hours, so the product obtained will contain an average of about 1.0 to 2.0 moles, preferably 1.1 to 1.4 moles, e.g. 1.2 moles, of the unsaturated acid per mole of the halogenated polymer. Processes of this general type are taught in U.S. Pat. Nos. 3,087,436; 3,172,892; 3,272,746 and others.

Alternatively, the olefin polymer, and the unsaturated acid material are mixed and heated while adding chlorine to the hot material. Processes of this type are disclosed in U.S. Pat. Nos. 3,215,707; 3,231,587; 3,912,764; 4,110,349; 4,234,435; and in U.K. 1,440,219.

By the use of halogen, about 65 to 95 wt. % of the polyolefin, e.g. polyisobutylene will normally react with the dicarboxylic acid material. Upon carrying out a thermal reaction without the use of halogen or a catalyst, then usually only about 50 to 85 wt. % of the polyisobutylene will react. Chlorination helps increase the reactivity. For convenience, all of the aforesaid functionality ratios of dicarboxylic acid producing units to polyolefin, e.g. 1.0 to 2.0, etc. are based upon the total amount of polyolefin, that is, the total of both the reacted and unreacted polyolefin, present in the resulting product formed in the aforesaid reactions.

Amine compounds useful as nucleophilic reactants for neutralization of the hydrocarbyl substituted dicarboxylic acid material include mono-and (preferably) polyamines, most preferably polyalkylene polyamines, of about 2 to 60 (e.g. 2 to 6), preferably 2 to 40, (e.g. 3 to 20) total carbon atoms and about 1 to 12 (e.g., 2 to 9), preferably 3 to 12, and most preferably 3 to 9 nitrogen atoms in the molecule. These amines may be hydrocarbyl amines or may be hydrocarbyl amines including other groups, e.g, hydroxy groups, alkoxy groups, amide groups, nitriles, imidazoline groups, and the like.

Hydroxy amines with 1 to 6 hydroxy groups, preferably 1 to 3 hydroxy groups are particularly useful. Preferred amines are aliphatic saturated amines, including those of the general formulas:

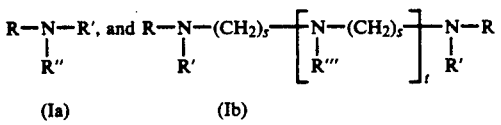

(Ia) (Ib)

wherein R, R', R'' and R''' are independently selected from the group consisting of hydrogen; $C_1$ to $C_{25}$ straight or branched chain alkyl radicals; $C_1$ to $C_{12}$ alkoxy $C_2$ to $C_6$ alkylene radicals; $C_2$ to $C_{12}$ hydroxy amino alkylene radicals; and $C_1$ to $C_{12}$ alkylamino $C_2$ to $C_6$ alkylene radicals; and wherein R''', can additionally comprise a moiety of the formula:

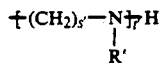

(Ic)

wherein R' is as defined above, and wherein each s and s' can be the same or a different number of from 2 to 6, preferably 2 to 4; and t and t' can be the same or different and are each numbers of typically from 0 to 10, preferably about 2 to 7, most preferably about 3 to 7, with the proviso that t+t' is not greater than 10. To assure a facile reaction it is preferred that R, R', R'', R''', (s), (s'), (t) and (t') be selected in a manner sufficient to provide the compounds of formulas Ia and Ib with typically at least one primary or secondary amine group, preferably at least two primary or secondary amine groups. This can be achieved by selecting at least one of said R, R', R'', or R''' groups to be hydrogen or by letting (t) in formula Ib be at least one when R''' is H or when the (Ic) moiety possesses a secondary amino group. The most preferred amines of the above formulas are represented by formula Ib and contain at least two primary amine groups and at least one, and preferably at least three, secondary amine groups.

Non-limiting examples of suitable amine compounds include: 1,2-diaminoethane; 1,3-diaminopropane; 1,4-diaminobutane; 1,6-diaminohexane; polyethylene amines such as diethylene triamine; triethylene tetramine; tetraethylene pentamine; polypropylene amines such as 1,2-propylene diamine; di-(1,2-propylene)triamine; di-(1,3-propylene)triamine; N,N-dimethyl-1,3-diaminopropane; N,N-di-(2-aminoethyl) ethylene diamine; N,N-di(2-hydroxyethyl)-1,3-propylene diamine; 3-dodecylpropylamine; N-dodecyl-1,3-propane diamine; trishydroxymethylaminomethane (THAM); diisopropanol amine; diethanol amine; triethanol amine; mono-, di-, and tri-tallow amines; aminomorpholines such as N-(3-aminopropyl) morpholine; and mixtures thereof.

Other useful amine compounds include: alicyclic diamines such as 1,4-di(aminomethyl) cyclohexane, and heterocyclic nitrogen compounds such as imidazolines, and N-aminoalkyl piperazines of the general formula (II):

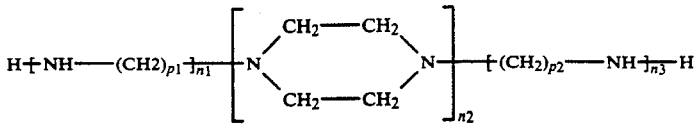

wherein $p_1$ and $p_2$ are the same or different and are each integers of from 1 to 4, and $n_1$, $n_2$ and $n_3$ are the same or different and are each integers of from 1 to 3. Non-limiting examples of such amines include 2-pentadecyl imidazoline; N-(2-aminoethyl) piperazine; and mixtures thereof.

Commercial mixtures of amine compounds may advantageously be used. For example, one process for preparing alkylene amines involves the reaction of an alkylene dihalide (such as ethylene dichloride or propylene dichloride) with ammonia, which results in a complex mixture of alkylene amines wherein pairs of nitrogens are joined by alkylene groups, forming such compounds as diethylene triamine, triethylenetetramine, tetraethylene pentamine and corresponding piperazines. Low cost poly(ethyleneamine) compounds averaging about 5 to 7 nitrogen atoms per molecule are available commercially under trade names such as "Polyamine H", "Polyamine 400", "Dow Polyamine E-100", etc.

Useful amines also include polyoxyalkylene polyamines such as those of the formulae:

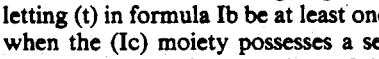

(III)

where m has a value of about 3 to 70 and preferably 10 to 35; and

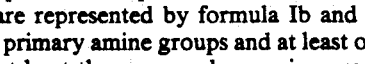

(IV)

where "n" has a value of about 1 to 40, with the provision that the sum of all the n's is from about 3 to about 70, and preferably from about 6 to about 35, and R is a substituted saturated hydrocarbon radical of up to 10 carbon atoms, wherein the number of substituents on the R group is represented by the value of "a", which is a number from 3 to 6. The alkylene groups in either formula (III) or (IV) may be straight or branched chains containing about 2 to 7, and preferably about 2 to 4 carbon atoms.

The polyoxyalkylene polyamines of formulas (III) or (IV) above, preferably polyoxyalkylene diamines and polyoxyalkylene triamines, may have number average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for example, from the Jefferson Chemical Company, Inc. under the trade name "Jeffamines D-230, D-400, D-1000, D-2000, T-403", etc.

The amine is readily reacted with the dicarboxylic acid material, e.g. alkenyl succinic anhydride, by heating an oil solution containing 5 to 95 wt. % of dicarboxylic acid material to about 100° to 200° C., preferably 125° to 175° C., generally for 1 to 10, e.g. 2 to 6 hours until the desired amount of water is removed. The heating is preferably carried out to favor formation of imides or mixtures of imides and amides, rather than amides and salts. Reaction ratios of dicarboxylic acid material to equivalents of amine as well as the other nucleophilic reactants described herein can vary considerably, depending upon the reactants and type of bonds formed. Generally from 0.1 to 1.0, preferably about 0.2 to 0.6, e.g. 0.4 to 0.6, moles of dicarboxylic acid moiety content (e.g. grafted maleic anhydride content) is used, per equivalent of nucleophilic reactant, e.g. amine. For example, about 0.8 mole of a pentamine (having two primary amino groups and 5 equivalents of nitrogen per molecule) is preferably used to convert into a mixture of amides and imides, the product formed by reacting one mole of olefin with sufficient maleic anhydride to add 1.6 moles of succinic anhydride groups per mole of olefin, i.e. preferably the pentamine is used in an amount sufficient to provide about 0.4 mole (that is $1.6/[0.8\times5]$ mole) of succinic anhydride moiety per nitrogen equivalent of the amine.

Tris(hydroxymethyl) amino methane (THAM) can be reacted with the aforesaid acid material to form amides, imides or ester type additives as taught by U.K. No. 984,409, or to form oxazoline compounds and borated oxazoline compounds as described, for example, in U.S. Pat. Nos. 4,102,798; 4,116,876 and 4,113,639.

The ashless dispersants may also be esters derived from the aforesaid long chain hydrocarbon substituted dicarboxylic acid material and from hydroxy compounds such as monohydric and polyhydric alcohols or aromatic compounds such as phenols and naphthols, etc. The polyhydric alcohols are the most preferred hydroxy compound and preferably contain from 2 to about 10 hydroxy radicals, for example, ethylene glycol, diethylene glycol, triethylene glycol, tetraethylene glycol, dipropylene glycol, and other alkylene glycols in which the alkylene radical contains from 2 to about 8 carbon atoms. Other useful polyhydric alcohols include glycerol, mono-oleate of glycerol, monostearate of glycerol, monomethyl ether of glycerol, pentaerythritol, dipentaerythritol, and mixtures thereof.

The ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding the esters of this invention comprise the ether-alcohols and amino-alcohols including, for example, the oxy-alkylene, oxy-arylene-, amino-alkylene-, and amino-arylene-substituted alcohols having one or more oxy-alkylene, amino-alkylene or amino-arylene oxy-arylene radicals. They are exemplified by Cellosolve, Carbitol, N,N,N',N',-tetrahydroxy-trimethylene diamine, and ether-alcohols having up to about 150 oxy-alkylene radicals in which the alkylene radical contains from 1 to about 8 carbon atoms.

The ester dispersant may be di-esters of succinic acids or acidic esters, i.e., partially esterified succinic acids; as well as partially esterified polyhydric alcohols or phenols, i.e., esters having free alcohols or phenolic hydroxyl radicals. Mixtures of the above illustrated esters likewise are contemplated within the scope of this invention.

The ester dispersant may be prepared by one of several known methods as illustrated for example in U.S. Pat. No. 3,381,022. The ester dispersant may also be borated, similar to the nitrogen containing dispersants, as described above.

Hydroxyamines which can be reacted with the aforesaid long chain hydrocarbon substituted dicarboxylic acid material to form dispersants include 2-amino-1-butanol, 2-amino-2-methyl-1-propanol, p-(beta-hydroxyethyl)-aniline, 2-amino-1-propanol, 3-amino-1-propanol, 2-amino-2-methyl-1,3-propane-diol, 2-amino-2-ethyl-1,3-propanediol, N-(beta-hydroxypropyl)-N'-(beta-amino-ethyl)-piperazine, tris(hydroxymethyl-)amino-methane (also known as trismethylolaminomethane), 2-amino-1-butanol, ethanolamine, beta-(beta-hydroxyethoxy)-ethylamine, and the like. Mixtures of these or similar amines can also be employed. The above description of nucleophilic reactants suitable for reaction with the hydrocarbyl substituted dicarboxylic acid or anhydride includes amines, alcohols, and compounds of mixed amine and hydroxy containing reactive functional groups, i.e.amino-alcohols.

A preferred group of ashless dispersants are those derived from polyisobutylene substituted with succinic anhydride groups and reacted with polyethylene amines, e.g. tetraethylene pentamine, pentaethylene hexamine, polyoxyethylene and polyoxypropylene amines, e.g. polyoxypropylene diamine, trismethylolaminomethane and pentaerythritol, and combinations thereof. One particularly preferred dispersant combination involves a combination of (A) polyisobutene substituted with succinic anhydride groups and reacted with (B) a hydroxy compound, e.g. pentaerythritol, (C) a polyoxyalkylene polyamine, e.g. polyoxypropylene diamine, and (D) a polyalkylene polyamine, e.g. polyethylene diamine and tetraethylene pentamine using about 0.3 to about 2 moles each of (B) and (D) and about 0.3 to about 2 moles of (C) per mole of (A) as described in U.S. Pat. No. 3,804,763. Another preferred dispersant combination involves the combination of (A) polyisobutenyl succinic anhydride with (B) a polyalkylene polyamine, e.g. tetraethylene pentamine, and (C) a polyhydric alcohol or polyhydroxy-substituted aliphatic primary amine, e.g., pentaerythritol or trismethylolaminomethane as described in U.S. Pat. No. 3,632,511.

A(ii) Also useful as ashless nitrogen-containing dispersant in this invention are dispersants wherein a nitrogen containing polyamine is attached directly to the long chain aliphatic hydrocarbon as shown in U.S. Pat. Nos. 3,275,554 and 3,565,804 where the halogen group on the halogenated hydrocarbon is displaced with various alkylene polyamines.

A(iii) Another class of nitrogen containing dispersants which may be used are those containing Mannich base or Mannich condensation products as they are known in the art. Such Mannich condensation products generally are prepared by condensing about 1 mole of a high molecular weight hydrocarbyl substituted mono- or polyhydroxy benzene (e.g., having a number average molecular weight of 1,000 or greater) with about 1 to 2 5 moles of formaldehyde or paraformaldehyde and about 0.5 to 2 moles polyalkylene polyamine as disclosed, e.g., in U.S. Pat. Nos. 3,442,808; 3,649,229 and 3,798,165 (the disclosures of which are hereby incorporated by reference in their entirety). Such Mannich condensation products may include a long chain, high molecular weight hydrocarbon on the phenol group or may be reacted with a compound containing such a hydrocarbon, e.g., polyalkenyl succinic anhydride as shown in said aforementioned U.S. Pat. No. 3,442,808.

The ashless dispersants should be free of boron-substitution so as to provide a fully formulated oleaginous composition which is substantially free of boron.

Component B—Friction Modifiers

The lubricating oil friction modifier additive comprise a friction modifying effective amount of at least one alcohol ester or hydroxyamide derivative of a carboxylic acid having a total of from 24 to 90 carbon atoms and at least 2, e.g., about 2 to 3, carboxylic acid groups per molecule. These ester friction modifier additives are generally derived from the esterification of a polycarboxylic acid with a di- or trihydric alcohol (e.g., glycol, glycerol, oxa-alkane diols). Such esters have been heretofore used in lubricating oils as friction modifiers, and the methods of preparation thereof, and structures, are described in U.S. Pat. Nos. 3,429,817; 4,459,223; 4,479,883; 4,617,026; and 4,683,069, the disclosures of which are hereby incorporated by reference in their entirety. The hydroxyamide derivatives of such polycarboxylic acids can be prepared by condensing the acid at elevated temperature with a hydroxyamine (e.g. alkanol amines or aminoalochols, such as ethanolamine, diethanol-amine, propanolamine, 3-amino-1,1-propanediol), employing the methods disclosed in U.S. Pat. No. 4,557,846, which is hereby incorporated by reference in its entirety.

The carboxylic acid may be an aliphatic saturated or unsaturated acid and will generally have a total of about 24 to 90, preferably about 24 to 60, carbon atoms and at least 2, e.g., about 2 to 3, preferably about 2, carboxylic acid groups with at least about 9 carbon atoms, preferably about 12 to 42, especially 16 to 22 carbon atoms between the carboxylic acid groups. Exemplary of the hydroxyamide compatibilizers are oil soluble hydroxyamide compounds having the formula:

$$J^1\left[-\overset{O}{\overset{\|}{C}}N(H)n_2(Z)n_3\right]_{n_4} \qquad (V)$$

wherein $J^1$ is the hydrocarbon radical or skeleton of a dimer carboxylic acid having a total of about 24 to about 90 carbon atoms with about 9 to about 42 carbon atoms between carboxylic acid groups; Z is (a) a hydroxy substituted alkyl group having about 1 to about 20 carbon atoms, or (b) an oxyalkylene group of the formula:

$$(\overset{A}{\overset{|}{C}}H-\overset{E}{\overset{|}{C}}HO)_{n_5}-H \qquad (VI)$$

where A and E are each alkyl of 1 to 2 carbon atoms or hydrogen and $n_5$ is an integer of 1 to 50; $n_2$ is 0 or 1; $n_3$ is 1 or 2 and $n_4$ is 1 or 2.

Preferred friction modifiers comprise partial esters or diesters of dicarboxylic acids of the formulas:

$$HO-J'-OOC-J-COOH \qquad \text{(VII), and}$$

$$HO-J'-OOC-J-COOJ''-OH \qquad (VIII)$$

wherein J is the hydrocarbon radical of the acid and J' and J'' is either the hydrocarbon radical of an alkane diol or the oxy-alkylene radical from an oxa-alkane diol as defined hereinbelow. Generally about 1-3 moles of glycol, preferably 1-2 moles of glycol, are used per mole of acid to provide either a complete or partial ester.

Also, esters can be obtained by esterifying a dicarboxylic acid or mixture of such acids with a mixture of diols, in which case J would then be the hydrocarbon radical of the dicarboxylic acid(s) and J' and J'' would be the hydrocarbon radicals associated with the diols.

The friction modifier additives are typically used in the lubricating oil composition in an amount of from about 0.0005 to 2, more preferably from about 0.001 to 0.25, and most preferably from about 0.005 to 0.1, weight percent.

Especially preferred friction modifier additives are the dimer acid esters. The term dimer acid used herein is meant to refer to those substituted cyclohexene dicarboxylic acids formed by a Diels-Alder-type reaction (which is a thermal condensation) of $C_{18}$–$C_{22}$ unsaturated fatty acids, such as tall oil fatty acids, which typically contain about 85 to 90 percent oleic or linoleic acids. Such dimer acids typically contain about 36 carbon atoms. The dimer acid structure can be generalized as follows:

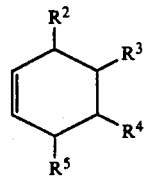

(IX)

with two of the $R^2$–$R^5$ groups being carboxyl groups and two being hydrocarbon groups depending upon how the condensation of the carboxylic acid has occurred. The carboxyl groups can be $-(CH_2)_8$ COOH; $-CH{=}CH$ $(CH_2)_8$ COOH; $-(CH_2)_7$ COOH; $-CH_2-CH{=}CH(CH_2)_7$ COOH; $-CH{=}CH(CH_2)_7$ COOH and the hydrocarbon terminating group can be represented by: $CH_3(CH_2)_4-$; $CH_3(CH_2)_5-$; $CH_3(CH_2)_4-$; $CH_3(CH_2)_4CH{=}CH-$; $CH_3(CH_2)_4CH{=}CHCH_2-$, and the like. The dimer of linoleic acid which is the preferred embodiment can be expressed in the following formula:

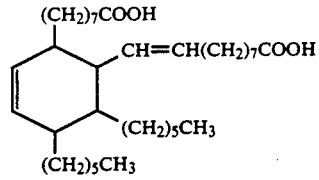

(X)

Also the term dimer acid as used herein necessarily includes products containing trimers (and higher homologues), e.g., up to about 24 percent by weight trimer, but more typically about 10 percent by weight trimer since, as is well known in the art, the dimerization reaction provides a product containing a trimer acid having molecular weight of about three times the molecular weight to the starting fatty acid.

The polycarboxylic acids or dimer acids noted above are esterified with a glycol, the glycol being an alkane diol or oxa-alkane diol represented by the formula $HO(R^6CHCH_2O)_{x1}H$ wherein $R^6$ is H or $CH_3$ and $x^1$ is about 1 to 100, preferably 1 to 25 with ethylene glycol and diethylene glycol particularly preferred. A preferred embodiment is formation of the ester with about 1 to 2 moles of glycol per mole of dimer acid or polycarboxylic acid, such as the ester of diethylene glycol with dimerized linoleic acid. Illustrative of such esters are compounds of the formula (XVI):

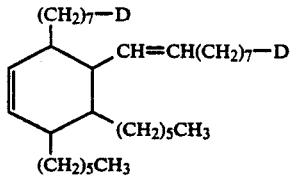

(XI)

wherein D is

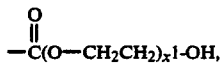

$x^1$ is as defined above.

The preparation and use of the foregoing polycarboxylic acid glycol esters as friction reducing esters (viz., friction modifiers) is disclosed in U.S. Pat. No. 4,505,829, the disclosure of which is hereby incorporated by reference in its entirety.

Component C—Copper Antioxidant

The antioxidants useful in this invention include oil soluble copper compounds. The copper antioxidants used in the present invention are non-overbased, that is, the selected compound is not overbased with carbon dioxide under conditions sufficient to form a copper-metal, carbonate-containing compound or complex. Therefore, the copper antioxidants are preferably characterized by a total base number (ASTM D2896) of less than 50, and most preferably less than 20.

The copper may be blended into the oil as any suitable oil soluble copper compound. By oil soluble we mean the compound is oil soluble under normal blending conditions in the oil or additive package. The copper compound may be in the cuprous or cupric form. The copper may be in the form of the copper dihydrocarbyl thio- or dithio-phosphates wherein copper may be substituted for zinc in the anti-wear compounds and reactions described below although one mole of cuprous or cupric oxide may be reacted with one or two moles of the dithiophosphoric acid, respectively.

Also useful are oil soluble copper dithiocarbamates of the general formula $(R^{31}R^{32}NCSS)_nCu$, where n is 1 or 2 and $R^{31}$ and $R^{32}$ are the same or different hydrocarbyl radicals containing from 1 to 18 and preferably 2 to 12 carbon atoms and including radicals such as alkyl, alkenyl, aryl, aralkyl, alkaryl and cycloaliphatic radicals. Particularly preferred as $R^{31}$ and $R^{32}$ groups are alkyl groups of 2 to 8 carbon atoms. Thus, the radicals may, for example, be ethyl, n-propyl, i-propyl, n-butyl, i-butyl, sec-butyl, amyl, n-hexyl, i-hexyl, n-heptyl, n-octyl, decyl, dodecyl, octadecyl, 2-ethylhexyl, phenyl, butylphenyl, cyclohexyl, methylcyclopentyl, propenyl, butenyl, etc. In order to obtain oil solubility, the total number of carbon atoms (i.e, $R^{31}$ and $R^{32}$) will generally be about 5 or greater. Copper sulphonates, phenates, and acetylacetonates may also be used.

A further example of useful copper antioxidants are oil soluble copper carboxylate compounds. The copper carboxylate compound may be added in the cuprous or cupric form, and can comprise a copper monocarboxylate or polycarboxylate, e.g., dicarboxylate, wherein the carboxylate moiety is derived from a monocarboxylic acid or polycarboxylic acid, e.g., dicarboxylic acid, of the formula:

$$R^7—CO_2H \quad \text{(XII)}$$

$$HO_2CR^8CO_2H \quad \text{(XIII)}$$

wherein $R^7$ is selected from the group consisting of alkyl, alkenyl, aryl, alkaryl, aralkyl and cycloalkyl, and wherein $R^8$ is selected from the group consisting of alkylene, alkenylene, arylene, alkarylene and aralkylene. Generally, acids XII and XIII will have at least about 6 to about 35 carbon atoms, and more usually from about 12 to about 24 carbon atoms, and more usually from about 18 to 20 carbon atoms.

Exemplary of alkyl $R^7$ groups are alkyls of from 5 to 34 carbon atoms, preferably 11 to 23 carbon atoms, and can be branched or straight chained, e.g., heptyl, octyl, nonyl, decyl, undecyl, dodecyl, tridecyl, tetradecyl, hexadecyl, octadecyl, 2-methylhexyl, 3,5-ethyloctyl, polybutylenes, polypropylene and the like. When $R^7$ is aryl, the aryl group will generally contain from about 6 to 20 carbon atoms, e.g., phenyl, naphthyl and the like. When $R^7$ is alkaryl, each above aryl group can be substituted by alkyl groups, which can be branched or straight chained, and the total carbon atoms in such alkaryl groups will generally contain from about 7 to 34, preferably 11 to 23, carbon atoms. Illustrative of such alkaryl groups are —Ar $(CH_3)$, —Ar $(C_2H_5)$, —Ar $(C_9H_{19})$, —Ar $(C_4H_9)_2$, —Ar $(CH_3)_2$, —Ar $(C_{10}H_{21})$, and the like, wherein "Ar" is a phenyl ring. When $R^7$ is alkenyl, the alkenyl group will generally contain from 5 to 34 carbon atoms, e.g., hexenyl, heptenyl, octenyl, dodecenyl, octadecenyl, and the like. When $R^7$ is aralkyl, the alkyl group, which can be branched or straight chained, can contain from 1 to 28 carbon atoms, and can be substituted by from 1 to 3 (e.g., 1 or 2) aryl groups, such as those described above (e.g., phenyl). Examples of such aralkyl groups are $ArCH_2$—, $ArC_2H_4$—, $ArC_8H_{16}$—, $ArC_9H_{18}$—, $CH_3CH(Ar)C_6H_{12}$—, and the like. When $R^7$ is cycloalkyl, the cycloalkyl group will generally contain from about 3 to 18 carbon atoms, e.g., cyclohexyl, cycloheptyl, cyclooctyl, cyclodecyl, cyclododecyl and the like.

Examples of monocarboxylic acids of formula XII are oleic acid, dodecanoic acid, naphthenic acid, linoleic acid, linolenic acid, cyclohexane carboxylic acid, phenyl acetic acid, benzoic acid, stearic acid, palmitic acid, myristic acid, lauric acid, and the like.

Exemplary of $R^8$ groups are straight chain alkylene of from 2 to 33 carbon atoms, e.g., $—(CH_2)_x—$, wherein x is an integer of from 2 to 33, and branched chain alkylenes of from 4 to 33 carbon atoms, e.g., $—CH_2—$, $—C_2H_4—$, $—C_3H_6—$, $—C_8H_{16}—$, $—C_{10}H_{20}—$, $—C_{12}H_{24}—$, $—C_{14}H_{28}—$, and the like . When $R^8$ is alkenylene, the $R^8$ group will generally contain from 4 to 33 carbon atoms, e g., $—CH=C_2H_3—$, $—CH_2CH=CHC_4H_8—$ and the like. When $R^8$ is arylene, the arylene group will generally contain from 6 to 20 carbon atoms, e.g., phenylene, naphthylene, and the like. The arylene groups may be alkyl substituted by from 1 to 14 carbon atoms. Exemplary of such alkarylene groups are $—Ar(CH_3)—$, $—Ar(C_2H_5)—$, $—Ar(CH_3)_2—$, $—Ar(CH_3)_3—$, and the like, wherein "Ar" is a phenyl ring. When $R^8$ is aralkylene, the alkylene groups as described above, can be substituted by one or more (e.g., 1-3) aryl groups, e.g., phenyl.

Examples of such dicarboxylic acids are phthalic acid, iso- and tere- phthalic acids, suberic acid, azelaic acid, sebacic acid, decanedioic acid, dodecanedioic acid, penta-, hepta-, hexa- and octa- decane dioic acids, and the like. Also exemplary are branched carboxylic acids such as napthenic acids of molecular weight from 200 to 500 or synthetic carboxylic acids.

The carbon atoms of the hydrocarbyl moieties of the acids of formula XII and XIII can be optionally substituted by an inert substituent, that is, a substituent which does not interfere with the acid-copper salt formation reaction, and which does not adversely affect the antioxidant effect of the copper carboxylate compound. Suitable such inert substituents include halide (e.g., Cl, Br), hydroxy, thio, amido, imido, cyano, thiocyano, isothiocyano, keto, carbalkoxy and the like. Preferably, the copper carboxylate is derived from alkanoic and alkenoic monocarboxylic acids of from 8 to 35 carbon atoms or saturated or unsaturated fatty dicarboxylic acids of from 8 to 35 carbon atoms. Especially preferred are copper salts of alkanoic monocarboxylic acids of from 12 to 24 carbon atoms containing $\leqq 3$ branches per chain, such as copper octanoate, copper oleate, copper dodecanoate, and the like. Examples include $C_{10}$ to $C_{18}$ fatty acids such as stearic or palmitic, but unsaturated acids such as oleic or branched carboxylic acids such as napthenic acids of molecular weight from 200 to 500 or synthetic carboxylic acids are preferred because of the improved handling and solubility properties of the resulting copper carboxylates.

Also exemplary of useful copper compounds are copper ($Cu^{I}$ and/or $Cu^{II}$) salts of alkenyl succinic acids or anhydrides. The salts themselves may be basic, neutral or acidic. They may be formed by reacting (a) any of the materials discussed above in the Ashless Dispersant section, which have at least one free carboxylic acid (or anhydride) group with (b) a reactive metal compound. Suitable acid (or anhydride) reactive metal compounds include those such as cupric or cuprous hydroxides, oxides, acetates, borates, and carbonates or basic copper carbonate.

Examples of the metal salts of this invention are Cu salts of polyisobutenyl succinic anhydride (hereinafter referred to as Cu-PIBSA), and Cu salts of polyisobutenyl succinic acid. Preferably, the selected metal employed is its divalent form, e.g., $Cu^{+2}$. The preferred substrates are polyalkenyl succinic acids in which the alkenyl group has a molecular weight greater than about 700. The alkenyl group desirably has a $\overline{M}_n$ from about 900 to 1400, and up to 2500, with a $\overline{M}_n$ of about 950 being most preferred. Especially preferred, of those listed above in the section on Dispersants, is polyisobutylene succinic acid (PIBSA). These materials may desirably be dissolved in a solvent, such as a mineral oil, and heated in the presence of a water solution (or slurry) of the metal bearing material. Heating may take place between 70° and about 200° C. Temperatures of 110° to 140° C. are entirely adequate. It may be necessary, depending upon the salt produced, not to allow the reaction to remain at a temperature above about 140° C. for an extended period of time, e.g., longer than 5 hours, or decomposition of the salt may occur.

The copper compounds useful as antioxidants herein can be formed by conventional means. Thus the copper carboxylate can be formed by contacting one or more of the above carboxylic acids with a copper source, such as a reactive inorganic or organic copper compound. Preferred copper sources are copper oxide, copper acetate, copper hydroxide, copper borate, copper carbonate, and the like. The acid and copper source generally will be contacted for reaction in the presence of a solvent or inert reaction diluent, e.g., water or alcohol, for a time and at a temperature sufficient to effect the desired reaction. Generally, a time of from about 0.5 to 24 hrs. and a temperature of from about 25° to 150° C. will be suitable, although contact times and temperatures outside of these ranges can be employed, if desired.

While any effective amount of the copper antioxidant can be incorporated into the lubricating oil composition, it is contemplated that such effective amounts be sufficient to provide said lube oil composition with an amount of the copper antioxidant of from about 5 to 500 (more preferably 10 to 200, still more preferably 10 to 180, and most preferably 20 to 130 (e.g., 90 to 120)) part per million of added copper based on the weight of the lubricating oil composition. The amount of copper antioxidant in this range should be at least sufficient to provide a B:Cu atomic ratio of from 0 to about 0.6:1, preferably less than about 0.4:1, and most preferably less than about 0.2:1. Of course, the preferred amount may depend amongst other factors on the quality of the basestock lubricating oil.

The copper antioxidants used in this invention are inexpensive and are effective at low concentrations and therefore do not add substantially to the cost of the product. The results obtained are frequently better than those obtained with previously used antioxidants, which are expensive and used in higher concentrations. The copper compounds can be utilized to replace part or all of the need for supplementary antioxidants. Thus, for particularly severe conditions it may be desirable to include a supplementary, conventional antioxidant. However, the amounts of supplementary antioxidant required are small, far less than the amount required in the absence of the copper compound.

The copper carboxylate can be formed by conventional means, as by contacting one or more of the above carboxylic acids with a copper source, such as a reactive inorganic or organic copper compound. Preferred copper sources are copper oxide, copper acetate, copper hydroxide, copper borate, copper carbonate, and the like. The acid and copper source generally will be contacted for reaction in the presence of a solvent or inert reaction diluent, e.g., water or alcohol, for a time and at a temperature sufficient to effect the desired reaction. Generally, a time of from about 0.5 to 24 hrs. and a temperature of from about 25° to 150° C. will be suitable, although contact times and temperatures outside of these ranges can be employed, if desired.

The copper antioxidants (e.g., Cu-oleate, Cu-naphthanate, etc. will be generally employed in an amount of from about 50–500 ppm by weight of the Cu metal, in the final lubricating or fuel composition. The amount of copper antioxidant in this range should be at least sufficient to provide a B:Cu atomic ratio of from 0 to about 0.6:1, preferably less than about 0.4:1, and most preferably less than about 0.2:1.

THE COMPOSITIONS

The additive mixtures of the present invention possess very good storage stability and friction modification properties as measured herein in a wide variety of environments. Accordingly, the additive mixtures are used by incorporation and dissolution into an oleaginous material such as fuels and lubricating oils. When the additive mixtures of this invention are used in normally liquid petroleum fuels such as middle distillates boiling from about 65° to 430° C., including kerosene, diesel fuels, home heating fuel oil, jet fuels, etc., a concentration of the additive in the fuel in the range of typically from about 0.001 to about 0.5, and preferably 0.001 to about 0.1 weight percent, based on the total weight of the composition, will usually be employed.

The additive mixtures of the present invention find their primary utility in lubricating oil compositions which employ a base oil in which the additives are dissolved or dispersed. Such base oils may be natural or synthetic. Base oils suitable for use in preparing the lubricating oil compositions of the present invention include those conventionally employed as crankcase lubricating oils for spark-ignited and compression-ignited internal combustion engines, such as automobile and truck engines, marine and railroad diesel engines, and the like. Advantageous results are also achieved by employing the additive mixtures of the present invention in base oils conventionally employed in and/or adapted for use as power transmitting fluids such as automatic transmission fluids, tractor fluids, universal tractor fluids and hydraulic fluids, heavy duty hydraulic fluids, power steering fluids and the like. Gear lubricants, industrial oils, pump oils and other lubricating oil compositions can also benefit from the incorporation therein of the additive mixtures of the present invention.

Thus, the additives of the present invention may be suitably incorporated into synthetic base oils such as alkyl esters of dicarboxylic acids, polyglycols and alcohols; polyalpha-olefins, alkyl benzenes, organic esters of phosphoric acids, polysilicone oil, etc.

Natural base oils include mineral lubricating oils which may vary widely as to their crude source, e.g. whether paraffinic, naphthenic, mixed, paraffinic-naphthenic, and the like; as well as to their formation, e.g., distillation range, straight run or cracked, hydrofined, solvent extracted and the like.

More specifically, the natural lubricating oil base stocks which can be used in the compositions of this invention may be straight mineral lubricating oil or distillates derived from paraffinic, naphthenic, asphaltic, or mixed base crudes, or, if desired, various blended oils may be employed as well as residuals, particularly those from which asphaltic constituents have been removed. The oils may be refined by conventional methods using acid, alkali, and/or clay or other agents such as aluminum chloride, or they may be extracted oils produced, for example, by solvent extraction with solvents of the type of phenol, sulfur dioxide, furfural, dichlorodiethyl ether, nitrobenzene, crotonaldehyde, etc.

The lubricating oil base stock conveniently has a viscosity of typically about 2.5 to about 12, and preferably about 2.5 to about 9 cst. at 100° C.

Thus, the additive mixtures of this invention, that is the non-borated ashless dispersant, friction modifier and copper antioxidants, can be employed in a lubricating oil composition which comprises lubricating oil, typically in a major amount, and the additive mixture, typically in a minor amount, which is effective to impart enhanced dispersancy, rust inhibition and oxidation inhibition, relative to the absence of the additive mixture. Additional conventional additives selected to meet the particular requirements of a selected type of lubricating oil composition can be included as desired.

The ashless dispersants, friction modifiers and copper antioxidants employed in this invention are oil-soluble, dissolvable in oil with the aid of a suitable solvent, or are stably dispersible materials. Oil-soluble, dissolvable, or stably dispersible as that terminology is used herein does not necessarily indicate that the materials are soluble, dissolvable, miscible, or capable of being suspended in oil in all proportions. It does mean, however, that the additives, for instance, are soluble or stably dispersible in oil to an extent sufficient to exert their intended effect in the environment in which the oil is employed. Moreover, the additional incorporation of other additives may also permit incorporation of higher levels of a particular dispersant, friction modifier, and/or copper antioxidant, if desired.

Accordingly, while any effective amount of the additive mixture can be incorporated into the lubricating oil composition, it is contemplated that such effective amount be sufficient to provide said lube oil composition with an amount of the additive of typically from about 0.01 to about 10 (e.g., 0.1 to 8), and preferably from about 0.2 to about 6 weight percent of the additive mixtures of this invention based on the weight of the active ashless dispersant, copper carboxylate antioxidant and friction modifier in said composition.

Preferably, the additive mixtures of this invention, and the components thereof, are used in an amount sufficient to provide fully formulated lubricating oil compositions containing from about 5 to 500 ppm oil soluble copper antioxidant compound (calculated as Cu metal), from about 0.01 to 5 wt. % friction modifier compound, and from about 1 to 8 wt. % of ashless dispersant, which is substantially free of boron as described above.

The additives of the present invention can be incorporated into the lubricating oil in any convenient way. Thus, they can be added directly to the oil by dispersing, or dissolving the same in the oil at the desired level of concentration. Such blending can occur at room temperature or elevated temperatures (e.g., at 70° to 130° C.). Alternatively, the additives may be blended with a suitable oil-soluble solvent and base oil to form a concentrate (e.g., "adpacks") and then the concentrate may be blended with lubricating oil base stock to obtain the final formulation. Such concentrates will typically contain (on an active ingredient (A.I.) basis) from about 3 to about 45 wt. %, and preferably from about 10 to about 35 wt. %, ashless dispersant additive A; from about 0.0005 to 2 wt. % typically from about 0.001 to 0.25 wt %, and preferably from about 0.005 to 0.1 wt. % friction modifier additive B; typically from about 0.005 to 1.0 wt. %, preferably from about 0.05 to 0.2 wt. %, copper antioxidant additive C (expressed as ppm by weight of added copper in the concentrate); and typically from about 30 to 90 wt. %, preferably from about 40 to 60 wt. %, base oil, based on the concentrate weight.

Such concentrates will typically contain from about 20 to about 80%, and preferably from about 25 to about 65%, by weight total active additive (that is, ashless dispersant, friction modifier, copper antioxidant and any other added additive, described below), and typically from about 80 to about 20%, preferably from about 60 to about 20% by weight base oil, based on the concentrate weight. Where present, for example, metal detergents will be typically present in such concentrates in an amount of from about from about 2 to 45 wt. %, and preferably from about 2 to 14 wt. %.

The lubricating oil base stock for the additives of the present invention typically is adapted to perform a selected function by the incorporation of additives therein to form lubricating oil compositions (i.e., formulations).

Representative additional additives typically present in such formulations include viscosity modifiers, corrosion inhibitors, other oxidation inhibitors, friction modifiers, anti-foaming agents, anti-wear agents, pour point depressants, detergents, metal rust inhibitors and the like.

The compositions of this invention can also be used with viscosity index (V.I.) improvers to form multigrade automotive engine lubricating oils. Viscosity modifiers impart high and low temperature operability to the lubricating oil and permit it to remain relatively viscous at elevated temperatures and also exhibit acceptable viscosity or fluidity at low temperatures. Viscosity modifiers are generally high molecular weight hydrocarbon polymers including polyesters. The viscosity modifiers may also be derivatized to include other properties or functions, such as the addition of dispersancy properties. These oil soluble viscosity modifying polymers will generally have number average molecular weights of from 103 to 106, preferably 104 to 106, e.g., 20,000 to 250,000, as determined by gel permeation chromatography or osmometry.

Examples of suitable hydrocarbon polymers include homopolymers and copolymers of two or more monomers of $C_2$ to $C_{30}$, e.g., $C_2$ to $C_8$ olefins, including both alpha olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher alpha olefins, atactic polypropylene, hydrogenated polymers and copolymers and terpolymers of styrene, e.g. with isoprene and/or butadiene and hydrogenated derivatives thereof. The polymer may be degraded in molecular weight, for example by mastication, extrusion, oxidation or thermal degradation, and it may be oxidized and contain oxygen. Also included are derivatized polymers such a s post-grafted interpolymers of ethylene-propylene with an active monomer such as maleic anhydride which may be further reacted with an alcohol, or amine, e.g. an alkylene polyamine or hydroxy amine, e.g. see U.S. Pat. Nos. 4,089,794; 4,160,739; 4,137,185; or copolymers of ethylene and propylene reacted or grafted with nitrogen compounds such as shown in U.S. Pat. Nos. 4,068,056; 4,068,058; 4,146,489 and 4,149,984.

The preferred hydrocarbon polymers are ethylene copolymers containing from 15 to 90 wt. % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, alpha-olefins. While not essential, such copolymers preferably have a degree of crystallinity of less than 25 wt. %, as determined by X-ray and differential scanning calorimetry. Copolymers of ethylene and propylene are most preferred. Exemplary are the improved ethylene-propylene copolymers disclosed in Ser. No. 72,825, filed July, 13, 1987 (the disclosure of which is hereby incorporated by reference in its entirety). Other alpha-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain alpha-olefins, such as 4-methyl-1-pentene, 4-methyl-1-hexene, 5-methylpentene-1, 4,4-dimethyl-1-pentene, and 6-methylheptene-1, etc., and mixtures thereof Terpolymers, tetrapolymers, etc., of ethylene, said $C_{3-28}$ alpha-olefin, and a non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and alpha-olefin present.

The polyester V.I. improvers are generally polymers of esters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl acrylate, stearyl acrylate, eicosanyl acrylate, docosanyl acrylate, decyl methacrylate, diamyl fumarate, lauryl methacrylate, cetyl methacrylate, stearyl methacrylate, and the like and mixtures thereof.

Other esters include the vinyl alcohol esters of $C_2$ to $C_{22}$ fatty or mono carboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g. 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g., see U.S. Pat. No. 3,702,300.

Such ester polymers may be grafted with, or the ester copolymerized with, polymerizable unsaturated nitrogen-containing monomers to impart dispersancy to the V.I. improvers. Examples of suitable unsaturated nitrogen-containing monomers include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g., N-vinyl pyrrolidones or N-vinyl piperidones.

The vinyl pyrrolidones are preferred and are exemplified by N-vinyl pyrrolidone, N-(1-methylvinyl) pyrrolidone, N-vinyl-5-methylpyrrolidone, N-vinyl-3,3-dimethylpyrrolidone, N-vinyl-5-ethyl pyrrolidone, and the like.

Corrosion inhibitors, also known as anti-corrosive agents, reduce the degradation of the metallic parts contacted by the lubricating oil composition. Illustrative of corrosion inhibitors are phosphosulfurized hydrocarbons and the products obtained by reaction of a phosphosulfurized hydrocarbon with an alkaline earth metal oxide or hydroxide, preferably in the presence of an alkylated phenol or of an alkylphenol thioester, and also preferably in the presence of carbon dioxide. Phosphosulfurized hydrocarbons are prepared by reacting a suitable hydrocarbon such as a terpene, a heavy petroleum fraction of a $C_2$ to $C_6$ olefin polymer such as polyisobutylene, with from 5 to 30 weight percent of a sulfide of phosphorus for ½ to 15 hours, at a temperature in the range of 65° to 315° C. Neutralization of the phosphosulfurized hydrocarbon may be effected in the manner taught in U.S. Pat. No. 1,969,324.

Oxidation inhibitors reduce the tendency of mineral oils to deteriorate in service which deterioration can be evidenced by the products of oxidation such as sludge and varnish-like deposits on the metal surfaces and by viscosity growth. Such oxidation inhibitors include alkaline earth metal salts of alkylphenol-sulfides and -thioesters having preferably $C_5$ to $C_{12}$ alkyl side chains (e.g., calcium nonylphenol sulfide, barium t-octylphenyl sulfide), di(octylphenyl)amine, phenyl-alpha-naphthylamine, phosphosulfurized or sulfurized hydrocarbons, etc.

Friction modifiers serve to impart the proper friction characteristics to lubricating oil compositions such as automatic transmission fluids.

Representative examples of suitable supplemental friction modifiers are found in U.S. Pat. No. 3,933,659 which discloses fatty acid esters and amides; U.S. Pat. No. 4,176,074 which describes molybdenum complexes of polyisobutenyl succinic anhydride-amino alkanols; U.S. Pat. No. 4,105,571 which discloses glycerol esters of dimerized fatty acids; U.S. Pat. No. 3,779,928 which discloses alkane phosphonic acid salts; U.S. Pat. No. 3,778,375 which discloses reaction products of a phosphonate with an oleamide; U.S. Pat. No. 3,852,205 which discloses S-carboxy-alkylene hydrocarbyl succinimide, S-carboxyalkylene hydrocarbyl succinamic acid and mixtures thereof; U.S. Pat. No. 3,879,306 which discloses N-(hydroxy-alkyl) alkenyl-succinamic acids or succinimides; U.S. Pat. No. 3,932,290 which discloses reaction products of di-(lower alkyl) phosphites and epoxides; and U.S. Pat. No. 4,028,258 which discloses the alkylene oxide adduct of phosphosulfurized N-(hydroxyalkyl) alkenyl succinimides. The disclosures of the above references are herein incorporated by reference. The most preferred friction modifiers are succinate esters, or metal salts thereof, of hydrocarbyl substituted succinic acids or anhydrides and thiobis alkanols such as described in U.S. Pat. No. 4,344,853.

Rust inhibitors useful in this invention comprise nonionic surfactants such as polyoxyalkylene polyols and esters thereof. Such anti-rust compounds are known and can be made by conventional means. Nonionic surfactants, useful as anti-rust additives in the oleaginous compositions of this invention, usually owe their surfactant properties to a number of weak stabilizing groups such as ether linkages. Nonionic anti-rust agents containing ether linkages can be made by alkoxylating organic substrates containing active hydrogens with an excess of the lower alkylene oxides (such as ethylene and propylene oxides) until the desired number of alkoxy groups have been placed in the molecule.

The preferred rust inhibitors are polyoxyalkylene polyols and derivatives thereof. This class of materials are commercially available from various sources: Pluronic Polyols from Wyandotte Chemicals Corporation; Polyglycol 112-2, a liquid triol derived from ethylene oxide and propylene oxide available from Dow Chemical Co.; and Tergitol, dodecylphenyl or monophenyl polyethylene glycol ethers, and Ucon, polyalkylene glycols and derivatives, both available from Union Carbide Corp. These are but a few of the commercial products suitable as rust inhibitors in the improved composition of the present invention.

In addition to the polyols per se, the esters thereof obtained by reacting the polyols with various carboxylic acids are also suitable. Acids useful in preparing these esters are lauric acid, stearic acid, succinic ac id, and alkyl- or alkenyl-substituted succinic acids wherein the alkyl-or alkenyl group contains up to about twenty carbon atoms.

The preferred polyols are prepared as block polymers. Thus, a hydroxy-substituted compound, $R^8$—$(OH)_{n_8}$ (wherein $n_8$ is 1 to 6, and $R^8$ is the residue of a mono- or polyhydric alcohol, phenol, naphthol, etc.) is reacted with propylene oxide to form a hydrophobic base. This base is then reacted with ethylene oxide to provide a hydrophylic portion resulting in a molecule having both hydrophobic and hydrophylic portions. The relative sizes of these portions can be adjusted by regulating the ratio of reactants, time of reaction, etc., as is obvious to those skilled in the art. Thus it is within the skill of the art to prepare polyols whose molecules are characterized by hydrophobic and hydrophylic moieties which are present in a ratio rendering rust inhibitors suitable for use in any lubricant composition regardless of differences in the base oils and the presence of other additives.

If more oil-solubility is needed in a given lubricating composition, the hydrophobic portion can be increased and/or the hydrophilic portion decreased. If greater oil-in-water emulsion breaking ability is required, the hydrophilic and/or hydrophobic portions can be adjusted to accomplish this.

Compounds illustrative of R—$(OH)_n$ include alkylene polyols such as the alkylene glycols, alkylene triols, alkylene tetraols, etc., such as ethylene glycol, propylene glycol, glycerol, pentaerythritol, sorbitol, mannitol, and the like. Aromatic hydroxy compounds such as alkylated mono- and polyhydric phenols and naphthols can also be used, e.g., heptylphenol, dodecylphenol, etc.

Other suitable demulsifiers include the esters disclosed in U.S. Pat. Nos. 3,098,827 and 2,674,619.

The liquid polyols available from Wyandotte Chemical Co. under the name Pluronic Polyols and other similar polyols are particularly well suited as rust inhibitors. These Pluronic Polyols correspond to the formula (XIV):

$$HO-(CH_2CH_2O)_x(\underset{\substack{|\\ CH_3}}{CH}CH_2O)_y(CH_2CH_2O)_z-H$$

wherein x, y, and z are integers greater than 1 such that the $CH_2CH_2O$ groups comprise from about 10% to about 40% by Weight of the total molecular weight of the glycol, the average molecular weight of said glycol being from about 1000 to about 5000.

These products are prepared by first condensing propylene oxide with propylene glycol to produce the hydrophobic base $$HO(-\underset{\substack{|\\ CH_3}}{CH}-CH_2-O)_y-H \qquad (XV)$$

This condensation product is then treated with ethylene oxide to add hydrophylic portions to both ends of the molecule. For best results, the ethylene oxide units should comprise from about 10 to about 40% by weight of the molecule. Those products wherein the molecular weight of the polyol is from about 2500 to 4500 and the ethylene oxide units comprise from about 10% to about 15% by weight of the molecule are particularly suitable. The polyols having a molecular weight of about 4000 with about 10% attributable to ($CH_2CH_2O$) units are particularly good. Also useful are alkoxylated fatty amines, amides, alcohols and the like, including such alkoxylated fatty acid derivatives treated with $C_9$ to $C_{16}$ alkyl-substituted phenols (such as the mono- and di-heptyl, octyl, nonyl, decyl, undecyl, dodecyl and tridecyl phenols), as described in U.S. Pat. No. 3,849,501, which is also hereby incorporated by reference in its entirety.

Pour point depressants lower the temperature at which the fluid will flow or can be poured. Such depressants are well known. Typical of those additives which usefully optimize the low temperature fluidity of the fluid are $C_8$–$C_{18}$ dialkylfumarate vinyl acetate copolymers, polymethacrylates, and wax naphthalene.

Foam control can be provided by an antifoamant of the polysiloxane type, e.g. silicone oil and polydimethyl siloxane.

Anti-wear agents, as their name implies, reduce wear of metal parts. Representative of conventional anti-wear agents are zinc dihydrocarbyldithiophosphates, e.g., wherein the hydrocarbyl groups are the same or different and are $C_1$ to $C_{18}$ (preferably $C_2$ to $C_{12}$) alkyl, alkenyl, aryl, alkaryl, aralkyl and cycloalkyl.

Detergents and metal rust inhibitors include the metal salts of sulphonic acids, alkyl phenols, sulfurized alkyl phenols, alkyl salicylates, naphthenates and other oil soluble mono- and di-carboxylic acids. Highly basic (that is, overbased) metal salts, such as highly basic alkaline earth metal sulfonates (especially Ca and Mg salts) are frequently used as detergents.

The highly basic alkaline earth metal sulfonates are usually produced by heating a mixture comprising an oil-soluble alkaryl sulfonic acid with an excess of alkaline earth metal compound above that required for complete neutralization of the sulfonic and thereafter forming a dispersed carbonate complex by reacting the excess metal with carbon dioxide to provide the desired overbasing. The sulfonic acids are typically obtained by the sulfonation of alkyl substituted aromatic hydrocarbons such as those obtained from the fractionation of petroleum by distillation and/or extraction or by the alkylation of aromatic hydrocarbons as, for example, those obtained by alkylating benzene, toluene, xylene, naphthalene, diphenyl and the halogen derivatives such as chlorobenzene, chlorotoluene and chloronaphthalene. The alkylation may be carried out in the presence of a catalyst with alkylating agents having from about 3 to more than 30 carbon atoms such as, for example, haloparaffins, olefins that may be obtained by dehydrogenation of paraffins, polyolefins as, for example, polymers from ethylene, propylene, etc. The alkaryl sulfonates usually contain from about 9 to about 70 or more carbon atoms, preferably from about 16 to about 50 carbon atoms per alkyl substituted aromatic moiety.

The alkaline earth metal compounds which may be used in neutralizing these alkaryl sulfonic acids to provide the sulfonates includes the oxides and hydroxides, alkoxides, carbonates, carboxylate, sulfide, hydrosulfide, nitrate, borates and ethers of magnesium, calcium, and barium. Examples of calcium oxide, calcium hydroxide, magnesium acetate and magnesium borate. As noted, the alkaline earth metal compound is used in excess of that required to complete neutralization of the alkaryl sulfonic acids. Generally, the amount ranges from about 100 to 220%, although it is preferred to use at least 125% of the stoichiometric amount of metal required for complete neutralization.

The preparation of highly basic alkaline earth metal alkaryl sulfonates are generally known as earlier indicated such as in U.S. Pat. Nos. 3,150,088 and 3,150,089 wherein overbasing is accomplished by hydrolysis of the alkoxide-carbonate complex with the alkaryl sulfonate in a hydrocarbon solvent-diluent oil. It is preferable to use such a hydrocarbon solvent-diluent oil for the volatile by-products can be readily removed leaving the rust inhibitor additive in a carrier, e.g., Solvent 150N lubricating oil, suitable for blending into the lubricating oil composition. For the purposes of this invention, a preferred alkaline earth sulfonate is magnesium alkyl aromatic sulfonate having a total base number (ASTM D2896) ranging from about 300 to about 400 with the magnesium sulfonate content ranging from about 25 to about 32 wt. % based upon the total weight of the additive system dispersed in Solvent 150 Neutral Oil.

Polyvalent metal alkyl salicylate and naphthenate materials are known additives for lubricating oil compositions to improve their high temperature performance and to counteract deposition of carbonaceous matter on pistons (U.S. Pat. No. 2,744,069). An increase in reserve basicity of the polyvalent metal alkyl salicylates and naphthenates can be realized by utilizing alkaline earth metal, e.g., calcium, salts of mixtures of $C_8$–$C_{26}$ alkyl salicylates and phenates (see U.S. Pat. No. 2,744,069) or polyvalent metal salts of alkyl salicylic acids, said acids obtained from the alkylation of phenols followed by phenation, carboxylation and hydrolysis (U.S. Pat. No. 3,704,315) which could then be converted into highly basic salts by techniques generally known and used for such conversion. The reserve basicity of these metal-containing rust inhibitors is usefully at TBN levels of between about 60 and 150. Included with the useful polyvalent metal salicylate and napththenate materials are the methylene and sulfur bridged materials which are readily derived from alkyl substituted salicylic or naphthenic acids or mixtures of either or both with alkyl substituted phenols. Basic sulfurized salicylates and a method for their preparation is shown in U.S. Pat. No. 3,595,791.

For purposes of this disclosure the salicylate/naphthenate rust inhibitors are the alkaline earth (particularly magnesium, calcium, strontium and barium) salts of the aromatic acids having the general formula:

$$HOOC—Ar(OH)R^9—X_y(ArR^9OH)_{n9} \quad (XVI)$$

where Ar is an aryl radical of 1 to 6 rings, $R^9$ is an alkyl group having from about 8 to 50 carbon atoms, ( preferably 12 to 30 carbon atoms (optimatically about 12) , X is a sulfur (—S—) or methylene (—$CH_2$—) bridge, y is a number from 0 to 4 and $n_9$ is a number from 0 to 4.

Preparation of the overbased methylene bridged salicylatephenate salt is readily carried out by conventional techniques such as by alkylation of a phenol followed by phenation, carboxylation, hydrolysis, methylene bridging via a coupling agent such as an alkylene dihalide followed by salt formation concurrent with carbonation. Overbased calcium salt o f a methylene bridged phenol-salicylic acids with a TBN of 60 to 150 is representative of a rust-inhibitor highly useful in this invention.

The sulfurized metal phenates can be considered the "metal salt of a phenol sulfide" which thus refers to a metal salt, whether neutral or basic, of a compound which can be prepared by reacting an alkyl phenol sulfide with a sufficient quantity of metal containing material to impart the desired alkalinity to the sulfurized metal phenate.

Regardless of the manner in which they are prepared, the sulfurized alkylphenols which are useful contain from about 2 to about 14% by weight, preferably about 4 to about 12 wt. % sulfur based on the weight of sulfurized alkylphenol.

The sulfurized alkyl phenol is converted by reaction with a metal containing material including oxides, hydroxides and complexes in an amount sufficient to neutralize said phenol and, if desired, to overbase the product to a desired alkalinity by procedures well known in the art. Preferred is a process of neutralization utilizing a solution of metal in a glycol ether.

The neutral or normal sulfurized metal phenates are those in which the ratio of metal to phenol nucleus is about 1:2. The "overbased" or "basic" sulfurized metal phenates are sulfurized metal phenates wherein the ratio of metal to phenol is greater than that of stoichiometry, e.g., basic sulfurized metal dodecyl phenate has a metal content up to and greater than 100% in excess of the metal present in the corresponding normal sulfurized metal phenates wherein the excess metal is produced in oil-soluble or dispersible form (as by reaction with $CO_2$).

According to a preferred embodiment the invention therefore provides a crankcase lubricating composition also containing from 2 to 8000 parts per million of calcium or magnesium.

The magnesium and/or calcium is generally present as basic or neutral detergents such as the sulphonates and phenates, our preferred additives are the neutral or basic magnesium or calcium sulphonates. Preferably the oils contain from 500 to 5000 parts per million of calcium or magnesium. Basic magnesium and calcium sulfonates are preferred.

These compositions of our invention may also contain other additives such as those previously described, and other metal containing additives, for example, those containing barium and sodium.

The lubricating composition of the present invention may also include copper lead bearing corrosion inhibitors. Typically such compounds are the thiadiazole polysulphides containing from 5 to 50 carbon atoms, their derivatives and polymers thereof. Preferred materials are the derivatives of 1,3,4 thiadiazoles such as those described in U.S. Pat. Nos. 2,719,125; 2,719,126; and 3,087,932; especially preferred is the compound 2,5-bis (t-octadithio)-1,3,4-thiadiazole commercially available as Amoco 150. Other similar materials also suitable are described in U.S. Pat. Nos. 3,821,236; 3,904,537; 4,097,387; 4,107,059; 4,136,043; 4,188,299; and 4,193,882.

Other suitable additives are the thio and polythio sulphenamides of thiadiazoles such as those described in U.K. Patent Specification 1,560,830. When these compounds are included in the lubricating composition, we prefer that they be present in an amount from 0.01 to 10, preferably 0.1 to 5.0 weight percent based on the weight of the composition.

Some of these numerous additives can provide a multiplicity of effects, e.g. a dispersant-oxidation inhibitor. This approach is well known and need not be further elaborated herein.

Compositions containing these conventional additives are typically blended into the base oil in amounts effective to provide their normal attendant function. Representative effective amounts of such additives (as the respective active ingredients) in the fully formulated oil are illustrated as follows:

| Compositions | Preferred Wt. % A.I. | Broad Wt. % A.I. |
|---|---|---|
| Ashless Dispersant (Component A) | .01-8 | .1-20 |
| Friction Modifier (Component B) | .01-1.5 | .01-5 |
| Copper Antioxidant (Component C) | 10-200 ppm by wt Cu | 5-500 ppm by wt Cu |
| Viscosity Modifier | .01-4 | .01-12 |
| Metal Detergents | .01-3 | .01-20 |
| Corrosion Inhibitor | .01-1.5 | .01-5 |
| Oxidation Inhibitor | .01-1.5 | .01-5 |
| Pour Point Depressant | .01-1.5 | .01-5 |
| Anti-Foaming Agents | .001-0.15 | .001-3 |
| Anti-Wear Agents | .001-1.5 | .001-5 |
| Mineral Oil Base | Balance | Balance |

When other additives are employed, it may be desirable, although not necessary, to prepare additive concentrates comprising concentrated solutions or dispersions of one or more of the dispersant, friction modifier compound and copper antioxidant used in the mixtures of this invention (in concentrate amounts hereinabove described), together with one or more of said other additives (said concentrate when constituting an additive mixture being referred to herein as an additive-package) whereby several additives can be added simultaneously to the base oil to form the lubricating oil composition. Dissolution of the additive concentrate into the lubricating oil may be facilitated by solvents and by mixing accompanied with mild heating, but this is not essential. The concentrate or additive-package will typically be formulated to contain the additives in proper amounts to provide the desired concentration in the final formulation when the additive-package is combined with a predetermined amount of base lubricant. Thus, the additive mixture of the present invention can be added to small amounts of base oil or other compatible solvents along with other desirable additives to form additive-packages containing active ingredients in collective amounts of typically from about 2.5 to about 90%, and preferably from about 15 to about 75%, and most preferably from about 25 to about 60% by weight additives in the appropriate proportions with the remainder being base oil.

The final formulations may employ typically about 7 wt. % of the additive-package with the remainder being base oil.

All of said weight percents expressed herein are based on active ingredient (A.I.) content of the additive, and/or upon the total weight of any additive-package, or formulation which will be the sum of the A.I. weight of each additive plus the weight of total oil or diluent.

This invention will be further understood by reference to the following examples, wherein all parts and percentages are by weight, unless otherwise noted and which include preferred embodiments of the invention.

EXAMPLE 1

Part A

A polyisobutenyl succinic anhydride (PIBSA) having a SA:PIB ratio of 1.1 succinic anhydride (SA) moieties per polyisobutylene (PIB) molecule (the PIB moieties having a $\overline{M}_n$ of about 2200 was aminated by reaction in S150N mineral oil with a commercial grade of polyethyleneamine (herein referred to as PAM) which was a mixture of polyethyleneamines averaging about 5 to 7 nitrogens per molecule, to form a polyisobutenyl succinimide containing about 0.97 wt. % nitrogen.

Part B —Boration

A portion of the dispersant of Part A was reacted with boric acid, then cooled and filtered to give a S150N solution containing (50% a.i.) to provide borated polyisobutenyl succinimide having a nitrogen content of about 0.97 wt. %, a boron content of about 0.25 wt. %, and 50 wt. % of unreacted PIB and mineral oil (S150N).

The following lubricating oil additive package concentrates were prepared using friction modifier additives comprising the diethylene glycol ester of linoleic dimer acid and selected dispersants from Examples 1A and 1B, together with alkali metal overbased sulfonate detergent inhibitor, copper salts of polyisobutylene succinic anhydride (derived from polyisobutylene, $\overline{M}_n$ =900) antioxidant, zinc dialkyl dithiophosphate antiwear agent (ZDDP), nonyl phenol sulfide (NPS) supplemental antioxidant and S100N diluent (where indicated). The weight ratio of dispersant to each of the other components was held constant within each of the two sets of concentrates (that is the same ratio was used in Concentrates A and B, and the same ratio used for Concentrates C and D).

Portions of each concentrate were stored at the selected temperatures for prolonged periods to evaluate their storage stability characteristics. The data thereby obtained are summarized in Table I.

TABLE I

| Formulation | Dispersant | Borated | Wt. % | Overbased Sulfonate, NPS, Copper Antioxidant & ZDDP, Wt. % | Friction Modifier Wt. % | Diluent Vol. % | Storage Stability Days Stable at 54° C. | Storage Stability Days Stable at 66° C. |
|---|---|---|---|---|---|---|---|---|
| A | Product of EX. 1-B | Yes | 50 | 48.4 | 1.5 | 0 | gel | gel |
| B | Product of EX. 1-A | No | 50 | 48.4 | 1.5 | 0 | 70 | 41 |
| C | Product of EX. 1-B | Yes | 46.3 | 45.8 | 1.5 | 6.4 | 14 | 7 |
| D | Product of EX. 1-A | No | 46.3 | 45.8 | 1.5 | 6.4 | >90 | >90 |

From the foregoing tests, it can be seen that the use of a non-borated dispersant in combination with a copper antioxidant and the friction modifier additive (Concentrates B and D) provided greatly improved storage stability as compared to the use of a borated dispersant in combination with the same antioxidant and friction modifier additives (Formulations A and C).

The principles, preferred embodiments, and modes of operation of the present invention have been described in the foregoing specification The invention which is intended to be protected herein, however, is not to be construed as limited to the particular forms disclosed, since these are to be regarded as illustrative rather than restrictive. Variations and changes may be made by those skilled in the art without departing from the spirit of the invention.

What is claimed is:

1. An oleaginous composition comprising lubricating oils and (A) an oil soluble ashless dispersant which comprises the oil soluble reaction product of a reaction mixture comprising:

(i) a hydrocarbyl substituted $C_4$ to $C_{10}$ monounsaturated dicarboxylic acid producing material formed by reacting olefin polymer of $C_2$ to $C_{10}$ monoolefin having a number average molecular weight of from about 300 to 5,000 and a $C_4$ to $C_{10}$ monounsaturated acid material, said acid producing material having an average of at least about 0.8 dicarboxylic acid producing moieties per molecule of said olefin polymer present in the reaction mixture used to form said acid producing material; and (ii) a nucleophilic reactant selected from the group consisting of amine, amino alcohol and mixtures thereof;

(B) an oil soluble friction modifier additive which comprises at least one glycol ester derivative of a polycarboxylic acid, and (C) an oil soluble copper antioxidant compound, said oleaginous composition being substantially free of boron.

2. The oleaginous composition according to claim 1 wherein said boron is present in a concentration of less than about 20 ppm by weight.

3. The composition according to claim 1, wherein the nucleophilic reactant of (b) is an amine.

4. The composition according to claim 3, wherein said amine is a polyethylenepolyamine, and said boron content in said composition is less than 10 ppm by weight.

5. The composition according to claim 1, wherein the nucleophilic reactant of (b) is an amino alcohol.

6. The composition according to claim 1 wherein in said acid producing material of (a) there are an average of from about 1.0 to 2.0 dicarboxylic acid producing moieties per molecule of said olefin polymer present in the reaction mixture used to form said acid producing material.

7. The composition according to claim 6 wherein said olefin polymer comprises a polymer of a $C_2$ to $C_4$ monoolefin having a molecular weight of from about 700 to 5000, and said $C_4$ to $C_{10}$ monounsaturated acid material comprises an alpha- or beta-unsaturated $C_4$ to $C_{10}$ dicarboxylic, anhydride or ester.

8. The composition according to claim 1 wherein said friction modifier is present in said composition in an amount of from about 0.01 to 5 wt. %.

9. The composition according to claim 8 wherein said copper antioxidant is employed in amounts of from about 5 to 500 parts per million by weight of added copper in the form of said oil soluble copper compound.

10. The composition according to claim 9 containing from 10 to 200 parts per million of said added copper.

11. The composition according to claim 9 wherein said copper compound is selected from the group consisting of copper salts of $C_{10}$ to $C_{18}$ fatty acids; copper salts of naphthenic acids having a molecular weight of 200 to 500, and copper salts of polyisobutenyl succinic anhydrides and polyisobutenyl succinic acids wherein said polyalkenyl group is derived from a polymer having a number average molecular weight greater than about 700.

12. The composition according to any one of claims 1-11 wherein said friction modifier comprises at least one member selected from the group consisting of glycol ester derivatives of polycarboxylic acids having a total of from 24 to 90 carbon atoms and at least about 2 carboxylic acid groups per molecule.

13. The composition according to claim 12 wherein said polycarboxylic acid glycol ester has about 2 to 3 carboxylic acid groups per molecule 14. The composition according to claim 13 wherein said friction modifier comprises at least one partial ester or diester of the formulas:

HO—J'—OOC—J—COOH, or

HO—J'—OOC—J—COOJ''—OH wherein J is the hydrocarbon radical of an aliphatic saturated or unsaturated polycarboxylic acid having a total of about 24 to 90 carbon atoms and about 2 to 3 carboxylic acid groups per molecule with at least about 9 carbon atoms between the carboxylic acid groups, J' and J'' are the same or different and each comprises the hydrocarbon radical of an alkane diol or an oxy-alkylene radical.

15. The composition according to claim 12 wherein said copper compound is characterized by a total base number of less than 50.

16. The composition according to claim 15 wherein said friction modifier additive comprises at least one dimer acid ester friction reducing ester.

17. The composition according to claim 16 wherein said friction modifier additive comprises esters of at least one substituted cyclohexene dicarboxylic acid formed by a Diels-Adler thermal condensation of tall oil fatty acids.

18. The composition according to claim 17 wherein said fatty acid comprises oleic acid, linoleic acid, or a mixture thereof 19. The composition according to claim 12 wherein said friction modifier additive comprises an ester of the formula:

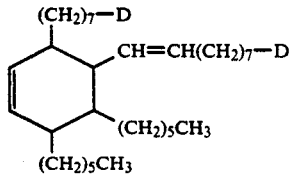

wherein D is $$-C(=O)-(CH_2CH_2)_{x'}-OH,$$

x' is an integer of from 1 to 100.

20. A lubricating oil concentrate of improved storage stability useful as an oil additive comprising lubricating oil and:

(A) from about 3 to 45 wt. % of a lubricating oil non-borated dispersant additive comprising at least one member selected from the group consisting of oil soluble salts, amides, imides, or mixtures thereof, of long chain hydrocarbon substituted mono and dicarboxylic acids or their anhydrides; wherein said long chain hydrocarbon group is a polymer of a $C_2$ to $C_{10}$, monoolefin, said polymer having a number average molecular weight of at least about 900;

(B) from about 0.0005 to 2 wt. % of a lubricating oil friction modifier material comprising at least one member selected from the group consisting of glycol ester derivatives of a polycarboxylic acid having a total of from 24 to 90 carbon atoms and at least about 2 carboxylic acid groups per molecule; and (C) from about 0.005 to 1 percent by weight of added copper in the form of an oil soluble copper antioxidant compound; said lubricating oil concentrate being substantially free of boron.

21. The concentrate according to claim 20 wherein said polycarboxylic acid glycol ester has about 2 to 3 carboxylic acid groups per molecule 22. The concentrate according to claim 20 wherein said friction modifier additive comprises at least one partial ester or diester of the formulas:

HO—J'—OOC—J—COOH, or

HO—J'—OOC—J—COOJ''—OH wherein J is the hydrocarbon radical of an aliphatic saturated or unsaturated polycarboxylic acid having a total of about 24 to 90 carbon atoms and about 2 to 3 carboxylic acid groups per molecule with at least about 9 carbon atoms between the carboxylic acid groups, J' and J'' are the same or different and each comprises the hydrocarbon radical of an alkane diol or an oxy-alkylene radical.

23. The concentrate according to claim 20 wherein said friction modifier is employed in an amount of from about 0.005 to 0.1 weight percent of said concentrate.

24. The concentrate according to claim 20 wherein said friction modifier additive comprises at least one dimer acid ester friction reducing ester.

25. The concentrate according to claim 24 wherein said friction modifier additive comprises esters of at least one substituted cyclohexane dicarboxylic acid formed by a Diels-Alder thermal condensation of tall oil fatty acids.

26. The Concentrate according to any one of claims 20-21 and 23-24 wherein said friction modifier additive comprises an ester of the formula:

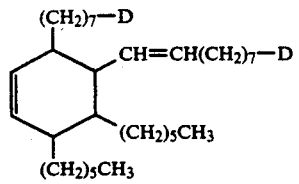

wherein D is $$-C(=O)-(O-CH_2CH_2)_{x'}-OH,$$

$_{x'}$—OH, x' is an integer of from 1 to 100.

27. The concentrate according to claim 26 containing from 0.05 to 0.2 percent by weight of said added copper.

28. The concentrate according to claim 27 wherein said copper compound is non-overbased and is selected from the group consisting of copper salts of $C_{10}$ to $C_{18}$ fatty acids; copper salts of naphthenic acids having a molecular weight of 200 to 500, and copper salts of polyisobutenyl succinic anhydrides and polyisobutenyl succinic acids wherein said polyalkenyl group is derived from a polymer having a number average molecular weight greater than about 700.

29. The concentrate according to claim 20 comprising:

(A) from about 3 to 45 wt % of a lubricating oil ashless dispersant additive comprising an oil soluble salt, amide, imide, or mixtures thereof of polyisobutenyl-substituted succinic acid or anhydride, said polyisobutenyl group being derived from polyisobutenylene polymer having a number average molecular weight of at least about 900;

(B) from about 0.001 to 0.25 wt. % of a friction modifier additive comprising at least one glycol ester derivative of a polycarboxylic acid having a total of from 24 to 90 carbon atoms and at least about 2 carboxylic acid groups per molecule; and (C) from about 0.05 to 0.2 percent by weight of added copper in the form of at least one oil soluble copper antioxidant compound.

30. The concentrate according to claim 29 which further comprises from about 2 to 45 wt % of a lubricating oil metal detergent additive material which comprises at least one magnesium or calcium salt of a material selected from the group consisting of sulfonic acids, alkyl phenols, sulfurized alkyl phenols, alkyl salicylates and naphthenates.

31. The concentrate according to claim 30, wherein said detergent additive comprises a basic magnesium or calcium sulfonate.

32. The concentrate according to any of claims 29 to 31 wherein said ashless dispersant comprises the reaction product of polyisobutenyl succinic anhydride with a polyalkylenepolyamine wherein said alkylene groups each contain 2 to 6 carbons and said polyalkylenepolyamine contains from 2 to about 9 nitrogen atoms per molecule.

33. The concentrate of claim 32, wherein said number average molecular weight of said polyisobutylene is from about 1500 to 3,000.

34. A process for forming a concentrate of improved storage stability useful as an oil additive which comprises: admixing at least one non-borated ashless dispersant lubricating oil additive, at least one friction modifier additive and at least one non-overbased copper antioxidant compound for a time and under conditions sufficient to form said concentrate wherein:

(A) said lubricating oil dispersant additive comprises at least one member selected from the group consisting of oil soluble salts, amides, imides, or mixtures thereof, of long chain hydrocarbon substituted mono and dicarboxylic acids or their anhydrides; wherein said long chain hydrocarbon group is a polymer of a $C_2$ to $C_{10}$, monoolefin, said polymer having a number average molecular weight of at least about 900, said dispersant additive being employed in an amount sufficient to provide a concentration of said dispersant additive of from about 3 to 45 wt. % in said concentrate;

(B) said friction modifier additive comprises a glycol ester derivative of a polycarboxylic acid having a total of from 24 to 90 carbon atoms and at least about 2 carboxylic acid groups per molecule; said friction modifier additive being employed in an amount sufficient to provide a concentration of said friction modifier additive of from about 0.0005 to 2 wt. % in said concentrate; and (C) said copper antioxidant compound being employed in an amount sufficient to provide from about 0.005 to 1 percent by weight of added copper in the form of said oil soluble copper antioxidant compound in said concentrate, said concentrate being substantially free of boron.

35. The process according to claim 34 wherein there is additionally provided in said concentrate at least one metal detergent additive material which comprises at least one magnesium or calcium salt of a material selected from the group consisting of sulfonic acids, alkyl phenols, sulfurized alkyl phenols, alkyl salicylates and naphthenates, in an amount of from about 2 to 45 wt. % in said concentrate.

36. The process according to claim 35 wherein said detergent additive comprises a basic magnesium or calcium sulfonate.

37. The process according to claim 35 wherein said ashless dispersant comprises the reaction product of polyisobutenyl succinic anhydride with a polyalkylenepolyamine wherein said alkylene groups each contain 2 to 6 carbons and said polyalkylenepolyamine contains from 2 to about 9 nitrogen atoms per molecule.

38. The process of claim 37, wherein said number average molecular weight of said olefin polymer is from about 1500 to 3,000.

39. The process according to claim 38 wherein said friction modifier additive comprises at least one glycol ester of a substituted cyclohexene dicarboxylic acid formed by a Diels-Alder thermal condensation of $C_{18}$–$C_{22}$ unsaturated fatty acids.

40. The process according to claim 39 wherein said unsaturated fatty acid comprises oleic acid, linoleic acid, or a mixture thereof.

41. The process according to claim 40 wherein said friction modifier comprises an ester of the formula:

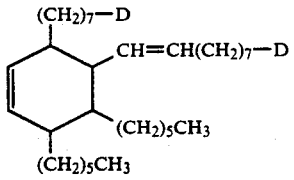

wherein D is

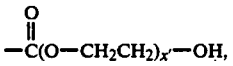

$_x$, is an integer of from 1 to 100.

42. The process according to claim 35 wherein said boron is present in a concentration of less than about 20 ppm by weight.

43. The process according to claim 42 wherein said copper antioxidant compound is employed in an amount sufficient to provide from 0.05 to 0.2 percent by weight of said added copper.

44. The process according to claim 37 wherein said copper compound is selected from the group consisting of copper salts of $C_{10}$ to $C_{18}$ fatty acids, copper salts of naphthenic acids having a molecular weight of 200 to 500, and copper salts of polyisobutenyl succinic anhydrides and polyisobutenyl succinic acids wherein said polyalkenyl group is derived from a polymer having a number average molecular weight greater than about 700.

45. The process according to claim 38 wherein said polyalkylenepolyamine comprises poly(ethyleneamine).

46. The composition according to claim 1 wherein the B:Cu atomic ratio is from 0 to about 0.6:1.

47. The composition according to claim 16 wherein the B:Cu atomic ratio is from 0 to about 0.6:1.

48. The concentrate according to claim 42 wherein said polyalkylenepolyamine comprises poly(ethyleneamine).

49. The concentrate according to claim 20 wherein the B:Cu atomic ratio is from 0 to about 0.6:1.

50. The concentrate according to claim 45 wherein the B:Cu atomic ratio is from 0 to about 0.6:1.

51. The concentrate according to claim 45 wherein the B:Cu atomic ratio is less than 0.2:1.

52. The process according to claim 34 wherein the B:Cu atomic ratio is from 0 to about 0.6:1.

53. The process according to claim 37 wherein the B:Cu atomic ratio is from 0 to about 0.6:1.

54. The process according to claim 39 wherein the B:Cu atomic ratio is from 0 to about 0.6:1.

* * * * *